United States Patent [19]

Cortopassi

[11] Patent Number: 4,807,776

[45] Date of Patent: Feb. 28, 1989

[54] MULTI-COMPARTMENTED CONTAINER ARRANGEMENT

[75] Inventor: Jeffery J. Cortopassi, Costa Mesa, Calif.

[73] Assignee: Taco Bell, Irvine, Calif.

[21] Appl. No.: 93,809

[22] Filed: Sep. 4, 1987

[51] Int. Cl.[4] ..... B65D 21/02

[52] U.S. Cl. ..... 220/23.83; 220/20

[58] Field of Search ..... 220/23.86, 23.83, 23.6, 220/20, 21

[56] References Cited

U.S. PATENT DOCUMENTS

| | | | |
|---|---|---|---|
| 2,210,521 | 8/1940 | Bemis | 220/23.83 |
| 2,469,032 | 5/1949 | Chaudron | 220/23.83 |
| 2,980,280 | 4/1961 | Herlow | 220/23.86 |
| 3,348,716 | 10/1967 | Nakata | 220/23.86 |
| 3,443,714 | 5/1969 | Edwards | 220/72 |
| 3,749,278 | 7/1973 | Von Boch-Galhau | 220/23.83 |
| 3,998,351 | 12/1976 | Smith et al. | 220/23.83 |
| 4,234,097 | 11/1980 | Daenen | 220/23.86 |
| 4,279,354 | 7/1981 | Conti | 220/23.83 |
| 4,491,233 | 1/1985 | Johnson | 220/23.83 |
| 4,595,113 | 6/1986 | Fafflok et al. | 220/23.83 |

*Primary Examiner*—Joseph Man-Fu Moy

*Attorney, Agent, or Firm*—Scully, Scott, Murphy & Presser

[57] ABSTRACT

A closeable container and, more specifically, a multi-compartmented container arrangement which is adapted for the separated stowage and dispensing of a plurality of different kinds of foodstuffs or items which are adapted to be carried in a discretely tiered and compartmented relationship within the container.

15 Claims, 4 Drawing Sheets

MULTI-COMPARTMENTED CONTAINER ARRANGEMENT

BACKGROUND OF THE INVENTION

1. Field of the Invention

The present invention relates to a closeable container and, more specifically, pertains to a multi-compartmented container arrangement which is adapted for the separated stowage and dispensing of a plurality of different kinds of foodstuffs or items which are adapted to be carried in a discretely tiered and compartmented relationship within the container.

Numerous types of containers are currently widely employed in commerce in the form of either single-compartment or multi-compartmented containers possessing sealable closures, particularly for the stowage and conveyance by a consumer of different kinds of food items from retail food outlets or restaurant establishments, especially for the packaging of "take out" orders from the highly popular so-called fast-food establishments. Generally, a closeable container of this nature, which may be of the single-compartment type, is employed for the temporary receipt and conveyance of either hot or cold food items, such as hamburgers, sandwiches, salads and the like, and wherein the food items are frequently dispensed and consumed directly from the container by a retail customer.

More recently, retail food establishments, particularly restaurants engaged in fast-food operations, have developed a highly successful "take-out" food retail sales strategy, in which various separate and combinable ingredients of a particular dish of a food, such as the items employed in making up tacos, burritos, or, for example, ingredients of a fried chicken dinner; i.e. chicken pieces, potatoes, gravy, salad, rolls, condiments and the like may be suitably packaged or placed into closed containers for carrying off the premises of the establishment, enabling the customer, at any desired location, to combine the various food items separately arranged within the container, into the desired food dish in accordance with the customer's taste. Thus, the compartments of a container may each have separately stored therein the applicable ingredients, such as sauces, meats, rolls, vegetables, salads, condiments, and the like of the desired food dish or items, which may then be mixed together and seasoned pursuant to the desires and palate of the customer.

A particularly desirable feature of such a multi-compartmented container resides in the aspect that various of the ingredients of the contemplated food dish or dishes may be stored in respective compartments within the container in a tiered or superimposed manner, pursuant to the inventive concept, so as to enable the various levels of the container contents to maintain the desired hot and/or cold properties or temperatures which are desirable by the customer for the particular type of food items in the container, during conveyance thereof from the food retail establishment or "fast food" restaurant to the home or office of the consumer, or any other suitable location for the consumption of the container contents.

2. Discussion of the Prior Art

A multi-purpose, multi-compartmented container incorporating a container sealing closure and food storing trays insertable into the container is disclosed in Swett, et al. U.S. Pat. No. 3,484,035. In that instance, a lower container portion has at least two compartments formed therein, with upper trays having ovate recesses formed therein for the receipt of eggs being adapted to be inserted into the lower container portion in superimposed relationship with the compartments, and thereafter a sealing closure is adapted to be superimposed on the lower container portion and the trays so as to provided a sealed container arrangement. Although the container is primarily adapted for the storage of eggs or the like, differently configured compartments and trays may conceivably be employed for the receipt of other kinds of comestibles or food items. However, although this patent publication pertains to the basic concept of employing a multi-compartmented container incorporating insertable trays for the receipt of food items, there is no disclosure nor suggestion of a multi-compartmented container arrangement of the inventive type in which a plurality of trays, which may or may not possess individual compartments for receiving different types of food ingredients adapted to be combined, if desired, into a specific dish, which are then inserted into a compartmented container having support structure for maintaining such trays in superimposed or tiered relationship therewithin, and with a container sealing closure being positionable on the assembled container and tray arrangement so as to enable the compartmented food items contained therein to be conveyed to any suitable location by a consumer.

SUMMARY OF THE INVENTION

The inventive multi-compartmented container arrangement incorporating a plurality of tiered and/or compartmented trays therein has particular advantageous utilization in connection with the purchase of "take out" food orders for restaurants, especially those engaged in so-called "fast food" operations, and affords customers the convenience of purchasing, and taking out from the restaurant premises the containerized and compartmented food ingredients to be able to make and season his own food dish in his own way pursuant to his palate, such as tacos, burritos, and other dishes allowing a customer to select and combine his own ingredients at will. Moreover, the tiered and compartmented storage of the various food items or ingredients within the container facilitates an appropriate hot/cold separation among the items, while enabling food items contained in superimposed tray compartments to be maintained at suitable temperatures over considerable periods of time through the heat or warmth rising from any hot food items stored in the compartments or tray below an upper compartment or tray without the need for supplying external energy or heating sources.

Accordingly, it is a primary object of the present invention to provide a multi-purpose, multi-compartmented container arrangement which incorporates insertable and superimposable storage trays.

A further object of the present invention resides in the provision of a sealable container arrangement of the type described having a plurality of tiered and/or compartmented trays therein enabling the separated storage of a plurality of food ingredients adapted to be combined into a food dish by a customer pursuant to his palate.

Still another object of the present invention is to provide a sealable multi-compartmented container of the type under consideration herein which enables a customer to purchase food items and/or ingredients at a fast food restaurant, separate store and transport them within the container, and to combine the items to his own taste and at his convenience into a desired dish of food.

Yet another object of the present invention is the provision of a multi-compartmented container arrangement incorporating container wall structure for supporting a plurality of superimposed trays in a predetermined tiered relationship within the container, and in which the respective superimposed trays are adapted to provide cover structures for the trays which are disposed therebelow.

BRIEF DESCRIPTION OF THE DRAWINGS

Reference may now be had to the following detailed description of an exemplary embodiment of the inventive multi-compartmented container arrangement, taken in conjunction with the accompanying drawings; in which.

DETAILED DESCRIPTION

Figure 1:
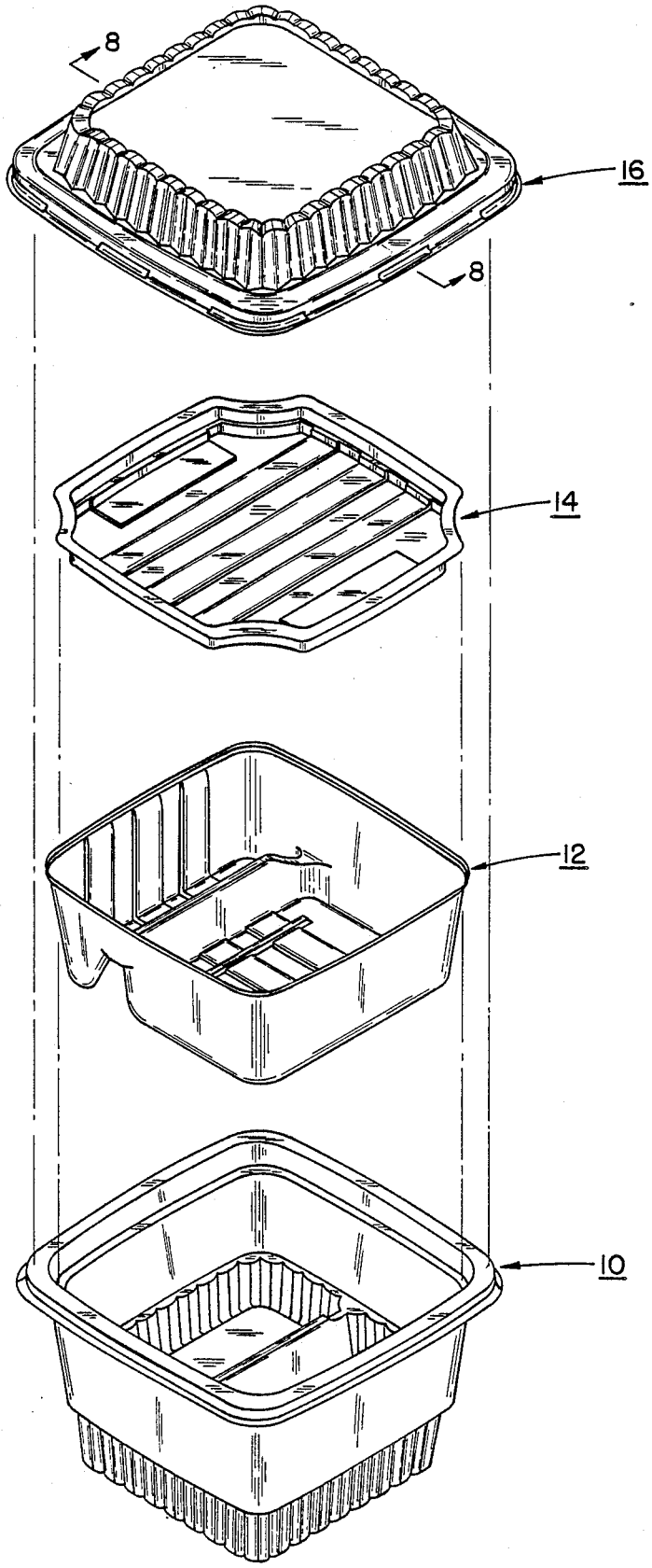
FIG. 1 illustrates an exploded perspective view of the inventive multi-compartmented container arrangement showing the insertable trays in position for superposition within the container.

Referring now in detail to the drawings, and more specifically to the exploded perspective illustration of FIG. 1, there is shown the inventive multi-compartmented container arrangement adapted for the separated storage of a plurality of food items or ingredients in trays providing for the compartmented and superimposed relationship thereof.

In essence, the container arrangement includes a compartmented container portion 10, superimposable tray members 12 and 14, of which at least the tray member 12 is compartmented, and a container cover or sealing closure 16 adapted to form a tight seal with the container portion 10 upon being superimposed thereon. Preferably, the various container and tray elements 10, 12, 14 and 16 are constituted of a liquid-impervious molded thermoplastic material, such as foamed polystyrene, or formed from other moldable plastic film material by molding or deep drawing dies, as is well known in the disposable plastic container producing technology; or alternatively, the container and tray elements may be formed of polyester-coated paperboard or the like suitable for the manufacture of food containers adapted for the storage of both hot and cold food items or comestibles.

Figure 2:
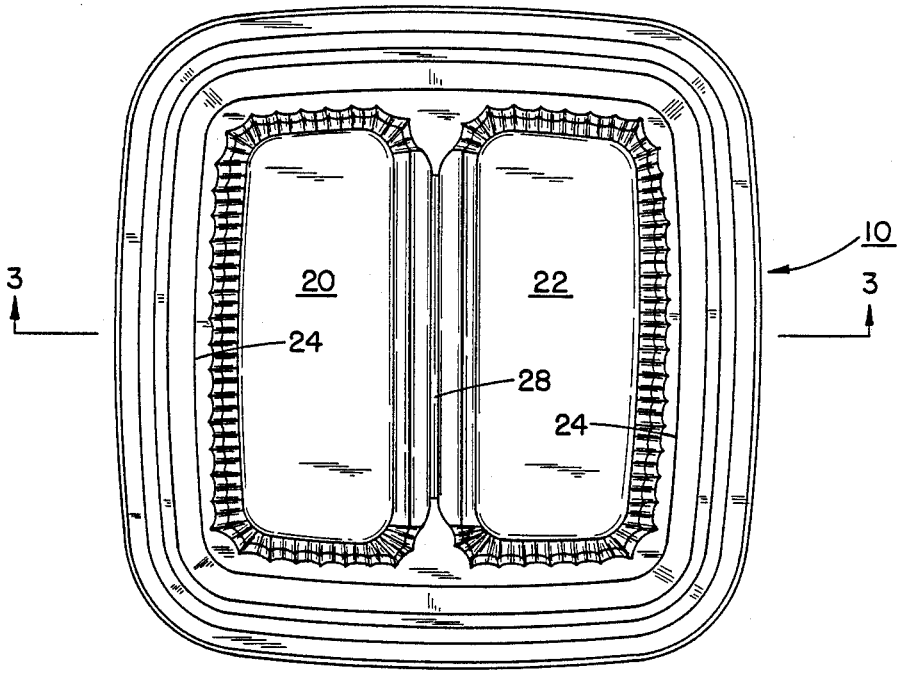
FIG. 2 illustrates a top plan view of the lower container portion of the container arrangement.
Figure 3:
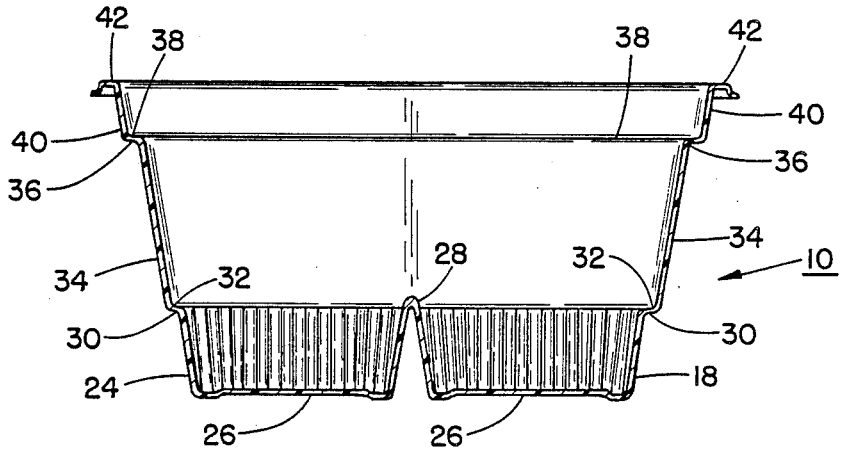
FIG. 3 illustrates a sectional view through the lower container portion taken along line 3—3 in FIG. 2.

As illustrated in more specific detail in FIGS. 2 and 3 of the drawings, the compartmented container portion 10 includes a container bottom structure 18 configured to form at least two compartments 20 and 22 defined by encompassing upstanding, and preferably slightly outwardly inclined, outer walls 24 and a bottom wall 26. The separation between the compartments 20 and 22 is provided by a central upstanding inverted V-shaped rib member 28 extending across the entire length of the bottom between the compartments 20, 22 and joining the inner surfaces of the upstanding walls 24 at the opposite ends thereof. The upstanding walls 24 which encompass each compartment 20, 22 along the three outer sides thereof, and at least the peripherally outer portion of the bottom wall 26 may be fluted or serrated in cross-section so as to impart additional stiffness and strength to the container compartments.

The upper ends of each of the upstanding walls 24 extend into a radially outwardly projecting peripheral or flange-like wall portion 30 along the three outer sides of each compartment 20, 22, and joining the opposite ends of the upstanding rib 28 such that the upper surface of the radially outwardly extending wall portion 30 forms a narrow peripheral ledge 32, the radially outer end of which extends into an upwardly and slightly outwardly inclined encompassing container wall portion 34.

At the upper end of the upwardly extending encompassing wall portion 34, the latter extends into a radially outwardly projecting wall portion 36 so as to form a peripheral flange-like ledge 38. The upper surface of the ledge 38, in turn, again extends at its radially outer end into an upwardly and outwardly inclined peripherally encompassing container wall portion 40.

At the upper end of the encompassing wall portion 40, the latter is provided with a radially outwardly and then downwardly depending surrounding flange 42, essentially forming an inverted U-shaped peripheral rim for the container 10 terminating in a short or narrow radially outwardly extending peripheral edge or ledge portion.

Figure 4:
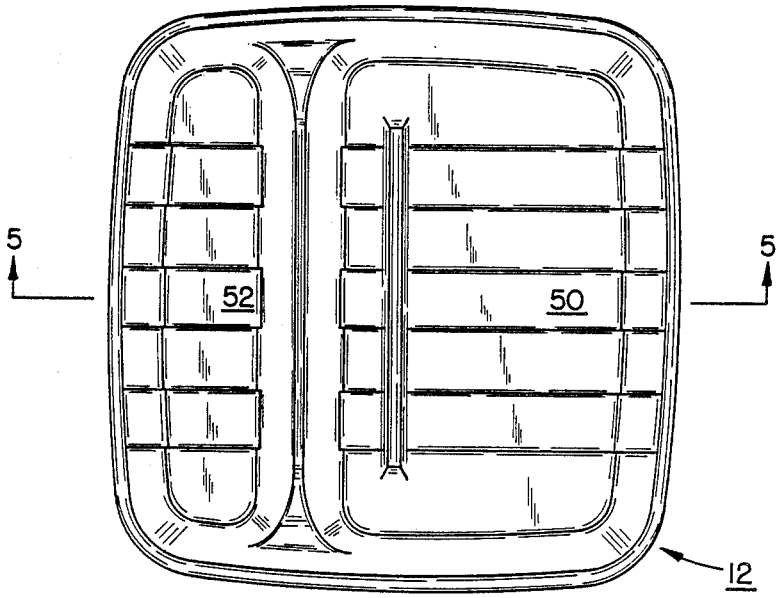
FIG. 4 illustrates a top plan view of a lower insertable compartmented tray.
Figure 5:
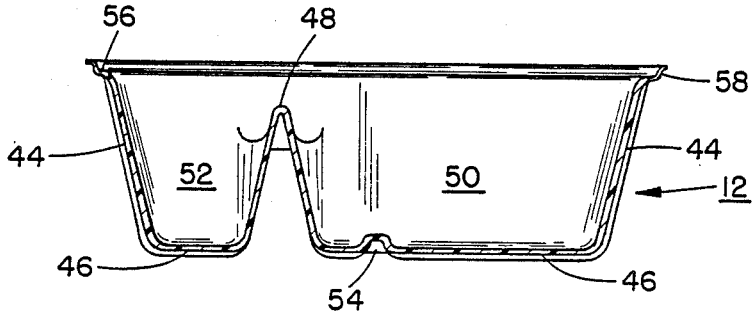
FIG. 5 illustrates a sectional view through the tray taken along line 5—5 in FIG. 4.

The compartmented tray member 12, as illustrated in detail in FIGS. 4 and 5, includes upwardly and outwardly inclined encompassing side walls 44 which are joined to the tray bottom wall 46. The bottom wall 46 of the tray member has an upstanding elongate rib 48, of essentially inverted V-shape, molded therein, which extending across the full width of the tray member to join opposite end walls 44, so as to constitute a divider between two compartments 50 and 52.

The divider or rib 48 may be offset from the center of the tray, as clearly illustrated in FIGS. 4 and 5, whereby the two compartments 50, 52 are of different size, although alternatively, if desired, the upstanding rib 48 may also be centrally located such that the compartments 50, 52 are equally-sized.

As shown in this embodiment of the tray member 12, the portion of the bottom wall 46 for the compartment 50 incorporates an upstanding narrow elongate depression 54 in its bottom surface which, in the inserted position of the tray member 12 in the container 10, may receive the upper edge of the container rib 28 therein so as to be supported thereon. The upper end of the upstanding wall portion 44 of the tray member 12 extends radially outwardly to form a narrow peripheral ledge 56 which, in turn, at its radially outer extremity continues into an outwardly inclined and upwardly projecting encompassing flange 58 which forms the upper rim or edge of the tray member 12.

Figure 6:
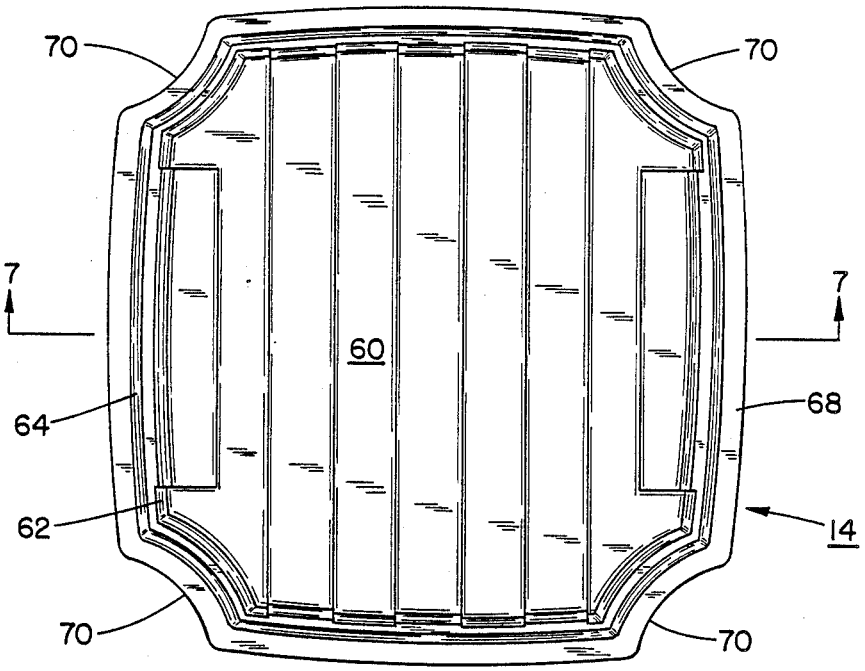
FIG. 6 illustrates a top plan view of an upper tray.
Figure 7:
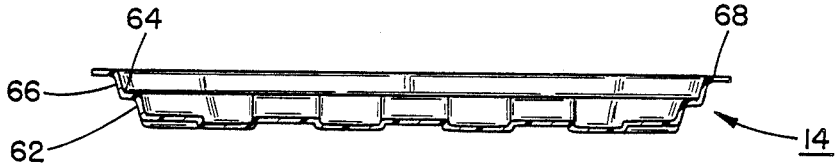
FIG. 7 illustrates a sectional view of the upper tray taken along line 7—7 in FIG. 6.

Referring now in particular to the configuration for the upper tray member 14, as shown in detail in FIGS. 6 and 7 of the drawings, this particular tray member is of a generally shallow dished-plate construction possessing a substantially flat or planar bottom wall 60 which, if desired, may be ribbed in cross-section, as more clearly shown in FIG. 7, so as t impart additional strength or stiffness to the tray member 14. Similar type of ribbed structure may also be imparted to the bottom and side walls of tray member 12 so as to enhance the stiffness thereof. The tray member 14 incorporates outwardly inclined upstanding encompassing walls 62 which, at their upper end, continue into a radially outwardly extending wall 64 forming a peripheral ledge and which in turn, at its outer radial end extends into an upwardly and outwardly inclined encompassing wall portion 66 terminating at the upper end thereof in a radially outwardly projecting peripheral flange 68 which forms the upper rim or edge of the tray member 14.

The tray member 14 may be provided with a plurality of peripherally spaced, arcuately configured notches or recesses 70 which, when the tray member is of rectangular configuration, are located at the four corners of the tray member and which permit for finger engagement and manual removal of the tray member from the container when inserted therein.

Figure 8:
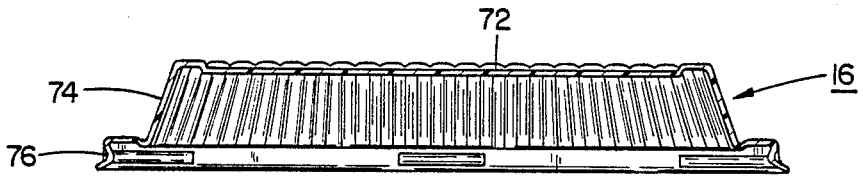
FIG. 8 illustrates a sectional view through the container closure taken along line 8—8 in FIG. 1.

The container cover or sealing closure 16, as shown in cross-sectional view in FIG. 8 of the drawings, may be of a generally dished structure having a substantially flat upper cover wall surface 72 with an outwardly inclined and downwardly depending peripheral wall structure 74 which, at its lower end, continues into an outwardly inclined and downwardly extending encompassing flange 76. When the sealing closure 16 is mounted on the container 10, the flange 76 engages with and forms a sealing closure in conjunction with the flange 42 on the upper end of the container portion 10. In order to impart stiffness or rigidity to the sealing closure 16, the depending wall structure 74 and the outer peripheral portions of the wall surface 72 may be of a fluted configuration in cross-section.

In effecting the assembly of the components of the inventive multi-compartmented container arrangement, the lower tray member 12 is initially inserted into the container portion 10 such that the outer surfaces of the sidewalls 44 of the tray member lie in close contact with the interior surfaces of the sidewalls 34 of the container portion 10, with the flange 58 of the tray 12 being supported on the ledge 38 of the container portion 10. Concurrently, the elongate recess 54 is supported along the upper edge of the rib 28, while the periphery of the bottom wall 46 of the tray member 12 rests on the ledge or flange 32 of the container portion 10. This provides a firm support for the inserted tray 12 while, concurrently, the bottom wall 46 and the lower surface of the divider 48 form a cover for the contents in the compartments 20, 22 of the container portion 10.

The upper tray member 14 is adapted to have the bottom surface of the peripheral flange 68 supported on the upper surface of the flange 42 of the container portion 10, while the outer or peripheral edge of the bottom 60 of the tray member outwardly of the upstanding walls 62 is adapted to be supported on the upper surface 56 of the flange 58 on the tray member 12 which is inserted in position therebelow within the container portion 10.

Thereafter, the container portion 10, with the tray member 12 and 14 inserted therein, and with appropriate food items or ingredients having been introduced into the various compartments 20, 22, 50, 52; and on the tray member 14, may be sealed by superimposing the cover or sealing closure 16 such that the inside wall surfaces of the flange 76 of the cover 16 sealingly engages the outside of the peripheral flange 42 on the container portion 10.

The upper tray member 14, and particularly the bottom 60 thereof, concurrently forms a cover structure for the contents of the compartments 50, 52 of the lower tray member 12 located therebeneath, while the warmth of any hot food items or ingredients in the compartments 50, 52, and/or those contained in the compartments 20, 22 of the container portion 10, may be conducted upwardly through the openings formed by the arcuate notches or recesses 70 in the tray member 14 so as to maintain any food items supported on the tray member 14 in a warm state.

From the foregoing it becomes readily apparent to one skilled in the art that the inventive multi-purpose, multi-compartmented container arrangement facilitates the separated storage and conveyance of various types of ingredients or food items in either hot and/or cold condition, and subsequently permits a retail customer to combine the various food items into a food dish in any desired manner pursuant to taste and palate as desired.

While there has been shown and described what is considered to be a preferred embodiment of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. A multi-compartmented container arrangement for the separated storage and conveyance of a plurality of food items, ingredients or the like; comprising in combination;

(a) an upwardly opening container including a compartmented bottom wall structure; and upstanding encompassing side walls extending from said bottom wall structure in a outwardly stepped configuration; each said side wall including a first outwardly stepped portion and a second outwardly stepped portion spaced a predetermined height above said first outwardly stepped portion;

(b) a first tray member insertable into said container and having a plurality of compartments formed therein, said first tray member having a bottom being supported in said container by said first outwardly stepped portion and a side wall by said second outwardly stepped portion of said upstanding sides walls in spaced relationship above the compartments in said container bottom wall structure such that the bottom of said first tray member forms a cover for the compartments in said container bottom wall structure;

(c) a second tray member insertable into said container and being supported by said upstanding container side walls in spaced superimposed relationship above said first tray member so as to form a cover for compartments of said first tray member;

(d) and a container closure superimposable on and engageable with the upper end of said upstanding container side walls so as to provide a sealed container arrangement in conjunction with said container.

2. A container arrangement as claimed in claim 1, wherein said container side walls each include a first side wall portion extending upwardly from the container bottom to a point intermediate the top and bottom of each said side wall; a first radially outwardly extending wall portion joining the upper end of said first side wall portion and defining the height of the compartments in said container bottom wall structure; a second side wall portion extending upwardly from said outwardly extending wall portion and terminating below the top of each said side wall; a second radially outwardly extending wall portion joining the upper end of said second side wall portion; a third side wall portion extending upwardly from said second outwardly extending wall portion and terminating in a radially outwardly and downwardly depending peripheral flange encompassing the upper opening of said container.

3. A container arrangement as claimed in claim 2, wherein said first tray member comprises dished elements member having a plurality of compartments therein, said first tray member having an outwardly and upwardly extending flange portion extending about the upper periphery thereof which is supported on said second outwardly extending container wall portion in the inserted position of said first tray member in said container.

4. A container arrangement as claimed in claim 3, wherein said first tray member has the peripheral bottom edges thereof supported on said first outwardly extending container wall portion when inserted into said container so as to cause the bottom of said first tray member to cover the compartments in the bottom wall structure of the container.

5. A container arrangement as claimed in claim 4, wherein said compartments in the container bottom wall structure are formed by at least one upstanding elongate rib integrally molded into the container bottom wall; and an elongate recess being molded into the bottom of said first tray member adapted to be seated on said upstanding rib for supporting the central bottom portion of said first tray member.

6. A container arrangement as claimed in claim 2, wherein said second tray member comprises a shallow flat-bottomed dished member having a radially outwardly projecting peripheral flange portion extending about the upper rim of said second tray member, said flange portion being supported on the upper surface of the container flange and the peripheral edges of the bottom of said second tray member being supported on the upper peripheral flange of said first tray member in the inserted condition of said first and second trays in said container.

7. A container arrangement as claimed in claim 6, wherein a plurality of finger engageable recesses are spaced about the periphery of said second tray member so as to facilitate manual removal of said tray member from said container.

8. A container arrangement as claimed in claim 6, wherein the bottom surface of said second tray member constitutes a cover the compartments in for said first tray member when inserted into said container.

9. A container arrangement as claimed in claim 1, wherein longitudinally extending ribs are molded into at least the bottom surfaces of said first and second tray members for enhancing the stiffness and strength of said tray members.

10. A container arrangement as claimed in claim 2, wherein said container closure comprises a downwardly opening dished member having a peripheral flange extending about the lower rim thereof, said flange being clampingly engageable with the peripheral flange extending about said container opening so as to form a sealed container arrangement in cooperation therewith.

11. A container arrangement as claimed in claim 1, wherein said container and said tray members are of a rectangular configuration.

12. A container arrangement as claimed in claim 11, wherein said container and tray members are substantially generally square in horizontal cross-section.

13. A container arrangement as claimed in claim 2, wherein said first side wall portions of the container include a plurality of upwardly extending, contiguous flutings about the periphery of said container to increase the rigidity of the lower compartmented portion of said container.

14. A container arrangement as claimed in claim 1, wherein said container and tray member are constituted of a molded thermoplastic material.

15. A container arrangement as claimed in claim 14, wherein the material of said container and tray members is liquid-impervious.

* * * * *